US006586745B2

(12) United States Patent
Hill, Jr. et al.

(10) Patent No.: US 6,586,745 B2
(45) Date of Patent: Jul. 1, 2003

(54) ULTRAVIOLET TARGET DESIGNATOR AND METHODOLOGY

(75) Inventors: Ralph H. Hill, Jr., San Antonio, TX (US); James R. Keys, Jr., San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 170 days.

(21) Appl. No.: 09/884,754

(22) Filed: Jun. 19, 2001

(65) Prior Publication Data

US 2002/0190222 A1 Dec. 19, 2002

(51) Int. Cl.[7] ..... G01J 5/00

(52) U.S. Cl. ..... 250/372

(58) Field of Search ..... 250/372; 119/712

(56) References Cited

U.S. PATENT DOCUMENTS

| | | | | |
|---|---|---|---|---|
| 5,574,286 | A * | 11/1996 | Huston et al. | 250/372 |
| 6,078,606 | A * | 6/2000 | Naiman et al. | 372/97 |
| 2002/0031783 | A1 * | 3/2002 | Empedocles et al. | 435/7.1 |
| 2002/0175294 | A1 * | 11/2002 | Lee et al. | 250/458.1 |

* cited by examiner

*Primary Examiner*—Constantine Hannaher
(74) *Attorney, Agent, or Firm*—Michelle Evans; Gunn, Lee & Hanov P.C.

(57) ABSTRACT

An ultraviolet target designator and methodology that utilizes ultraviolet radiation from a laser designator to remotely designate targets for various applications. In one embodiment, the ultraviolet laser designator is used to remotely designate a target for insects to fly to so as to collect environmental information. In another embodiment, the ultraviolet laser operates in the solar blind region to remotely designate a target. When used in conjunction with a solar blind camera, the targeting can be performed without detection by infrared or visible detection devices.

14 Claims, 1 Drawing Sheet

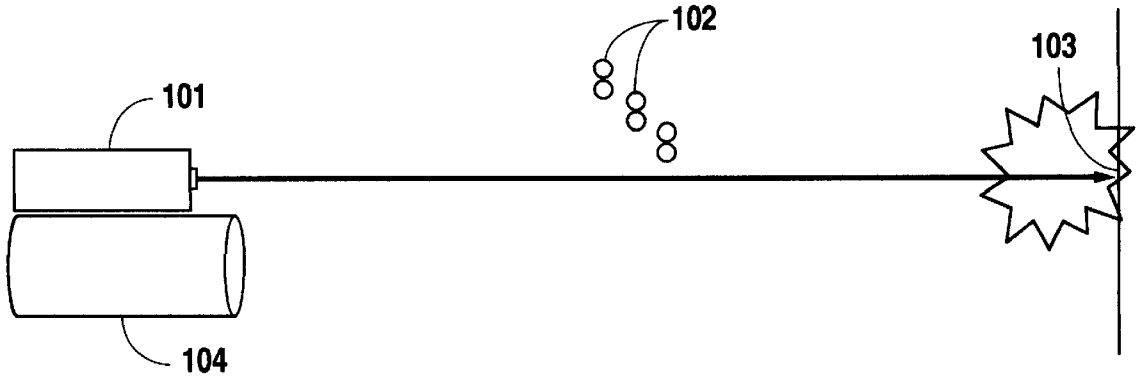
Fig.

ULTRAVIOLET TARGET DESIGNATOR AND METHODOLOGY

BACKGROUND OF THE INVENTION

This invention was made with government support under Contract No. N66001-00-C-8049 awarded by the Defense Advanced Research Projects Agency (DARPA)/Defense Sciences Office (DOS). The United States Government has certain rights in this invention.

1. Field of the Invention

Applicant's invention relates to an ultraviolet target designator and methodology that utilizes ultraviolet radiation from a laser designator to remotely designate targets for various applications. In one embodiment, the ultraviolet laser designator is used to remotely designate a target for insects to fly to so as to collect environmental information. In another embodiment, the ultraviolet laser operates in the solar blind region to remotely designate a target. When used in conjunction with a solar blind camera, the targeting can be performed without detection by visible or infrared detection devices.

2. Background Information

Presently, the threat of biological or chemical agents to troops, civilians, and ecosystem is growing. Research to develop novel methods of measuring threats posed by such agents is aimed at early warning, remediation, and monitoring. Biological organisms can indicate and functionally respond to the presence of known and unknown threats in several ways which can be useful for defense purposes. In the present invention, it was desired that these biological organisms have the ability to collect information in the environment about the acute presence of chemical or biological agents to determine their biological activity and predict the toxicity of various chemical and biological threats to our combat forces and civilian communities. Intelligence data in the form of audio and video information may be collected as well.

Biological organisms have adapted unique sensing and locomotion schemes in order to distribute into environments in search of food, reproduction, and predator avoidance. Unfortunately, the ability to discriminate specific signals in a complex background in a wide variety of environments and to use these signals to effect distribution into those environments currently exceeds any defense capability. The ability to passively monitor, influence, or control the distribution of individual or populations of biological organisms can result in the ability to rapidly collect environmental information.

In order to accomplish this objective, there must be an understanding and utilization of the sensory signals and sensorimotor behavior employed by biological systems and exploitation of the neural biomechanical control circuitry used for the activities mentioned above, such as foraging, mate identification, and predator avoidance. Understanding and using signal discrimination methods and sensory fusion in a complex environment and understanding how biological organisms navigate in the environment are also critical. For higher level organisms, the integration of neurobiology and behavior in training programs could result in the ability to train a biological organism to seek out signals of interest.

Various insects and small animals are being adapted for use in military situations. For instance, *Manduca sexta* moths are being used to target a sex pheromone. In ongoing experiments the male moths are attracted to the female pheromone, which is typically distributed with a small fan blowing over a dispenser impregnated with the pheromone. Difficulties exist in using pheromones since wind and air drafts moving the pheromone plume or diluting the pheromone so much can render the pheromone useless. The present invention overcomes these limitations and can be used with the pheromones or independently to improve the moths effectiveness in military applications.

It is well known that many insects are attracted to ultraviolet (UV) light. Because of this the present invention utilizes an ultraviolet laser as a target designator to induce the moths to go to a remote target. Existing methods to get the target in place are impossible. Once the remote target is designated with the ultraviolet laser, the moths head toward the laser spot. Therefore, the moths can be induced to go to a remote target of choice, collect intelligence data, such as aerosol samples or video data, and return to the point of origin or go to a third location where the data is processed. The sighting device can vary based on the situation. In addition, the ultraviolet target designator of the present invention can be used in the solar blind range in the conventional manner, but more covertly than existing infrared devices. The ultraviolet laser operates in the solar blind region to remotely designate a target. When used in conjunction with a solar blind camera the targeting can be performed without detection by infrared or visible detection devices.

SUMMARY OF THE INVENTION

It is an object of the present invention to provide a novel ultraviolet target designator.

It is another object of the present invention to provide a novel ultraviolet target designator that induces insects to collect information in the environment about the acute presence of chemical or biological agents.

Still another object of the present invention is to provide a novel ultraviolet target designator that allows mapping chemical or biological agent concentration and distribution in potentially contaminated air, land, and water.

Another object of the present invention is to provide a novel ultraviolet target designator that allows information gathering in hostile and/or inaccessible environments.

It is another object of the present invention to provide a novel ultraviolet target designator operating in the solar blind region that can be used in conjunction with a solar blind camera system to allow the designator to function in the solar blind region which is invisible to existing infrared equipment.

Still another object of the present invention is to provide a novel ultraviolet target designator that utilizes a 266 nm quadrupled Neodymium yttrium aluminum garnet (Nd:YAG) laser and a solar blind camera.

An additional object of the present invention is to provide a novel method for designating targets for insects utilizing ultraviolet lasers.

Yet another object of the present invention is to provide a novel method for designating targets for insects using ultraviolet laser wavelengths in the range of 300–400 nm.

Still another object of the present invention is to provide a novel method for designating remote targets to prevent detection by infrared detection eqiupment.

In satisfaction of these and related objectives, Applicant's present invention provides for an ultraviolet target designator and methodology that utilizes ultraviolet radiation from a laser designator to remotely designate targets for various applications. In one embodiment, the ultraviolet laser designator is used to remotely designate a target for insects to fly to so as to collect environmental information. In another embodiment, the ultraviolet laser operates in the solar blind region to remotely designate a target. When used in conjunction with a solar blind camera, the targeting can be performed without detection by infrared or visible detection devices.

BRIEF DESCRIPTION OF THE DRAWINGS

FIG. 1 is a perspective view of the preferred embodiment of the present invention.

DETAILED DESCRIPTION OF THE PREFERRED EMBODIMENT

Referring to FIG. 1, a perspective view of the preferred embodiment of the present invention is shown. It is well known that many insects are attracted to ultraviolet light which is invisible to humans. Ultraviolet light exists between 160–380 nm. Because of this the present invention utilizes an ultraviolet laser 101 as a target designator to induce the insects 102, primarily *Manduca sexta* moths, to go to a remote target 103 to retrieve certain information. Existing methods to get the target 103 in place are impossible. Additionally, the present invention can be used to guide the insects 102 to the remote target 103. The ultraviolet laser is in the range of 355 nm (tripled Nd:YAG laser) or 325 nm (helium cadmium), but any similar laser could be used to designate the remote target 103.

Once the remote target 103 is designated with the ultraviolet laser 101, the ultraviolet light will scatter on the remote target 103 and the insects 102 will head toward the laser spot. A sufficient number of insects 102, such as approximately 10 to 15 insects, must be sent in order to ensure success in collecting the environmental information. Therefore, the insects 102 can be induced to go to a remote target 103 of choice, collect intelligence data, such as aerosol samples, audio or video data. When aerosol samples are desired, they can be obtained by preferably placing aerogel (absorbant) patches on the insects 102 before they enter the designated target area. The data can be collected from the insects 102 by inducing the insects 102 movement back to the point of origin or to a third location by pheromone attraction or by moving the ultraviolet laser spot to the new location. The aerosol sample patches can be removed from the insects 102 at this time and chemically analyzed or in some cases calorimetrically analyzed on the insect 102. This invention may be adapted for use with animals as well.

In order to view the target designation, a sighting device 104 is used. The sighting device 104 for the target designation can vary based on the situation, but can include a UV camera, low-light level charge-coupled device (CCD) camera[1], infrared, or visible sighting device. Insect 102 movement is typically visualized with a camera such as a low light level CCD camera[2] or infrared illuminated camera. The laser spot in contrast would typically be viewed with a UV viewing device such as a UV viewer or UV camera.

[1] A CCD camera uses a small piece of silicon rather than a piece of film to receive incoming light. The silicon is called a charge-coupled device (CCD).
[2] Id.

In a second embodiment of the present invention, the ultraviolet target designator of the present invention can be used in the conventional manner without insects, but more covertly than existing infrared devices. The ultraviolet laser operating in the solar blind spectral range could be used to target an object in conjunction with a solar blind camera system which would be used to view the laser spot. The ultraviolet solar blind spectral range exists between 240 nm. and 280 nm. In this range, no solar radiation reaches the surface of the earth. Instead, radiation in this spectral band is absorbed by the ozone layer in the atmosphere. An advantage of detection in the UV solar blind range is complete absence of background radiation. With the designator operating in the solar blind region, it would be invisible to existing infrared detection equipment which operates at wavelengths between 700 nm and 0.01 mm. The ultraviolet laser in this instance would preferably be a 266 nm quadrupled Nd:YAG laser. This embodiment effectively shifts the wavelength region of operation and hence is more effective against countermeasures or detection by the enemy when targeting is in progress. In another application of this embodiment, an ultraviolet seeker, such as a missile, would be used to seek out the target.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. An apparatus for inducing insects to a remote target in the environment to collect data comprising:

an ultraviolet laser used to designate said remote target wherein when said ultraviolet laser designates said remote target ultraviolet light from said laser will scatter inducing said insects to move to said remote target to collect said data.

2. The apparatus for inducing insects to a remote target in the environment to collect data of claim 1 wherein said ultraviolet laser is a tripled Nd:YAG laser operating in the range of 355 nm.

3. The apparatus for inducing insects to a remote target in the environment to collect data of claim 1 wherein said ultraviolet laser is a helium cadmium laser operating in the range of 325 nm.

4. A method of designating a remote target to induce insects to the remote target in the environment to collect data in the form of aerosol samples, audio, video data or the like comprising the steps of:

shining an ultraviolet light from an ultraviolet laser to said remote target;

scattering said ultraviolet light on said remote target; and allowing said insects to head toward said remote target for collection of said data from said environment.

5. The method of claim 4 wherein said ultraviolet laser is a tripled Nd:YAG laser operating in the range of 355 nm.

6. The method of claim 4 wherein said ultraviolet laser is a helium cadmium laser operating in the range of 325 nm.

7. The method of claim 4 further comprising the step of viewing said scattering of said ultraviolet light.

8. A method of using insects to collect data from the environment in the form of aerosol samples, audio, video data or the like comprising the steps of:

shining an ultraviolet light from an ultraviolet laser to a remote target;

scattering said ultraviolet light on said remote target; and allowing said insects to head toward said remote target from their point of origin for collection of said data from said environment.

9. The method of claim 8 wherein said ultraviolet laser is a tripled Nd:YAG laser operating in the range of 355 nm.

10. The method of claim 8 wherein said ultraviolet laser is a helium cadmium laser operating in the range of 325 nm.

11. The method of claim 8 wherein comprising the step of collecting said data from said insects.

12. The method of claim 11 wherein said collecting step requires inducing said insects back to said point of origin or to a third location.

13. The method of claim 12 further comprising the step of analyzing said data.

14. The method of claim 12 wherein said inducing occurs by the use of pheromones or by shining said ultraviolet laser on said point of origin or said third location.

* * * * *